US012806490B2

(12) United States Patent
Elkington

(10) Patent No.: US 12,806,490 B2
(45) Date of Patent: Nov. 24, 2026

(54) GOLF TEE

(71) Applicant: Custom Golf International Pty Ltd, Warriewood (AU)

(72) Inventor: Gordon William Elkington, Mornington (AU)

(73) Assignee: CUSTOM GOLF INTERNATIONAL PTY LTD, Warriewood (AU)

( * ) Notice: Subject to any disclaimer, the term of this patent is extended or adjusted under 35 U.S.C. 154(b) by 0 days.

(21) Appl. No.: 18/393,920

(22) Filed: Dec. 22, 2023

(65) Prior Publication Data

US 2025/0001269 A1 Jan. 2, 2025

(51) Int. Cl.
*A63B 57/13* (2015.01)
*A63B 57/16* (2015.01)

(52) U.S. Cl.
CPC ..... *A63B 57/16* (2015.10); *A63B 57/13* (2015.10)

(58) Field of Classification Search
CPC ..... A63B 57/10; A63B 57/13
See application file for complete search history.

(56) References Cited

U.S. PATENT DOCUMENTS 1,679,579 A * 8/1928 Lundy ..... A63B 57/10 473/401
1,692,191 A * 11/1928 Towsley ..... A63B 57/10 473/403
1,864,516 A * 6/1932 Becket ..... A63B 57/10 206/820
3,883,144 A * 5/1975 Lazow ..... A63B 57/10 473/218
4,998,732 A * 3/1991 Gallant ..... A63B 57/10 473/401
D316,286 S * 4/1991 Johnson ..... D21/718
D331,271 S * 11/1992 Blake ..... D21/718
5,571,055 A * 11/1996 Lewis ..... A63B 57/10 473/402
D482,086 S * 11/2003 Metz ..... D21/718
D583,428 S * 12/2008 Worth ..... D21/718
D583,429 S * 12/2008 Worth ..... D21/718
D621,456 S * 8/2010 Cathro ..... D21/718
8,167,741 B1 * 5/2012 Murken ..... A63B 57/16 473/401
8,403,776 B1 * 3/2013 Gruenwald ..... A63B 57/10 473/387

(Continued)

FOREIGN PATENT DOCUMENTS

AU 2015101519 A4 * 3/2016

*Primary Examiner* — Nicholas J. Weiss
(74) *Attorney, Agent, or Firm* — FINNEGAN, HENDERSON, FARABOW, GARRETT & DUNNER LLP

(57) ABSTRACT

A golf tee for supporting a golf ball comprising a rigid spine section comprising a first spine end and a second spine end; a barb located at the first spine end adapted for insertion of the golf tee into the ground in a substantially vertical position; and a ball rest section located at the second spine end; wherein the spine section is elongate comprising to opposing flat edges and two opposing rounded edges; wherein the ball rest section is circular and comprises a plurality of raised castellations adapted to support the golf ball when the barb is inserted into the ground in a substantially vertical position; and wherein the castellations are circumferentially distributed around an upper surface of the ball rest section.

16 Claims, 6 Drawing Sheets

(56) References Cited

U.S. PATENT DOCUMENTS

| | | | | |
|---|---|---|---|---|
| 8,597,141 | B1 * | 12/2013 | Daniel | A63B 57/16<br>473/387 |
| 9,216,337 | B2 * | 12/2015 | Carroll | B29C 45/14336 |
| 9,937,398 | B1 * | 4/2018 | Iverson | B29C 45/1418 |
| D1,005,424 | S * | 11/2023 | Chu | D21/718 |
| 12,005,329 | B2 * | 6/2024 | Palairet | A63B 57/10 |
| 2002/0013186 | A1 * | 1/2002 | Webb | A63B 57/13<br>473/399 |
| 2007/0082757 | A1 * | 4/2007 | Burrowes | A63B 57/10<br>473/387 |
| 2017/0157477 | A1 * | 6/2017 | Carroll, Jr. | A63B 57/10 |

* cited by examiner

GOLF TEE

CROSS-REFERENCE TO RELATED APPLICATIONS

This application claims the benefit of priority from Australian Provisional Application No. 2023902020, filed on Jun. 27, 2023, the disclosure of which is herein incorporated by reference in its entirety.

FIELD OF THE INVENTION

The present invention relates to a golf tee and in particular to a golf tee for improving the interaction between said golf tee and a golf club/ball.

The invention has been developed primarily as an improved golf tee and will be described hereinafter with reference to this application. However, it will be appreciated that the invention is not limited to this particular field of use.

BACKGROUND

Any discussion of the background art throughout the specification should in no way be considered as an admission that such background art is prior art, nor that such background art is widely known or forms part of the common general knowledge in the field in Australia or worldwide as at the priority date of the present application.

All references, including any patents or patent applications, cited in this specification are hereby incorporated by reference, which means that it should be read and considered by the reader as part of this text. That the document, reference, patent application or patent cited in this text is not repeated in this text is merely for reasons of conciseness.

Those skilled in the art will appreciate that the invention described herein is susceptible to variations and modifications other than those specifically described. The invention includes all such variation and modifications. The invention also includes all of the steps, features, formulations, and compounds referred to or indicated in the specification, individually or collectively and any and all combinations of any two or more of the steps or features.

Golf is a very technical sport, where slight variations in swing, gear, or technique can have a big impact on the outcomes. An important goal for the majority of golfers, from beginners to professionals, is to achieve consistent impact and therefore regulate ball flight. The intricate interplay between the ground, the golf tee, the ball, and the golf club as it impacts the ball from the tee is one of the many components that affect impact and ball flight.

In order to hit the ball when playing golf, a golf tee is typically used. A golf tee is used for playing the game and when practising, particularly on driving ranges and similar facilities. Traditional golf tees are made of a single component with a centred shaft that can be inserted into the ground and a cupped ball holder that holds the ball at an appropriate height above the ground for hitting. The entire tee is secured to the ground in such a design. In most golf tee designs, the top of the golf tee is often a cup-shaped or concave surface that makes complete direct contact with the convex curvature of the golf ball's outer surface. When the golf ball is struck, such close contact generates a lot of friction and other interfering factors. A large amount of energy from the golf club head is transferred to the tee and the ground instead of the ball when the ball is placed in the concave surface of the tee because the lip of the tee obstructs the ball's trajectory and spin.

In general, to maximise the ball flight distance off the tee, players with slower-ball-speed need higher launch angle and higher ball spin rate while players with faster ball speeds require lower launch and lower spin rate. Thus, ball spin is one of many critical factors which affects the flight distance of the ball, and is commonly used as an indicator to optimise a players swing and club selection.

Should the golfer contact the tee, the resistance force supplied by this anchoring to the ground is transmitted to the clubface of the golf club, which may affect the ball's path, speed, and location of impact, as well as the flight of the ball as a result. Furthermore, the ground resistance is still transferred to the golf club via the golf ball even if a player simply hits the ball off the tee rather than the tee itself, affecting the critical strike parameters once more.

Tees are generally inexpensive devices, often made of wood, which are easily broken. A typical tee 1 (illustrated in FIG. 1) includes a cylindrical shaft 3 that is pointed at one end 5 for penetrating the ground, and includes at the other end a concave, round ball rest 7 centred above the shaft, which is complementary to the geometry of golf ball 10. Optimally, the tee 1 will elevate and stabilize the position of the golf ball 10 prior to the tee-off swing, but will not interfere with the ball's movement once it has been struck by the club. Unfortunately, the objectives of stabilizing the ball and minimizing interference are often at odds. The greater the stabilizing contact the tee has with a golf ball, the more resistance it will exert on the ball. Even the slightest contact of the tee with the ball can affect the ball's lift, spin and/or forward motion.

A variety of approaches have been devised to overcome these limitations. For example, golf tees that have with a smaller ball rest 7 and those with a multiplicity or plurality of individual arms support the ball having a smaller tee to ball contact area than the conventional golf tee shown in FIG. 1 have been described (see, for example, U.S. Pat. Nos. 8,435,139; 7,704,166; 6,344,003; 6,053,822; D695,86; D604,375 and D597,156).

There is a need to provide a golf tee that causes the least amount of resistance or interference with the clubface of a golf club.

SUMMARY

It is an object of the present invention to overcome or ameliorate at least one or more of the disadvantages of the prior art, or to provide a useful alternative.

The present invention provides golf tees that are configured to exert minimal resistance or friction on a golf ball, thereby allowing the golf ball to travel further.

According to a first aspect of the invention, there is provided a golf tee for supporting a golf ball. The tee may comprise a rigid spine section comprising a first spine end and a second spine end. The tee may further comprise a barb located at the first spine end adapted for insertion of the golf tee into the ground in a substantially vertical position. The tee may further comprise a ball rest section located at the second spine end. The spine section may be elongate comprising two opposing flat edges and two opposing rounded edges. The ball rest section may be circular. The ball rest section may comprise a plurality of raised castellations adapted to support the golf ball when the barb is inserted into the ground in a substantially vertical position. The castellations may be circumferentially distributed around an upper surface of the ball rest section.

According to a particular arrangement of the first aspect, there is provided a golf tee for supporting a golf ball comprising:

- a rigid spine section comprising a first spine end and a second spine end;
- a barb located at the first spine end adapted for insertion of the golf tee into the ground in a substantially vertical position; and
- a ball rest section located at the second spine end;
- wherein the spine section is elongate comprising two opposing flat edges each extending the length of the spine between the first and second spine ends and two opposing rounded edges each extending the length of the spine between the first and second spine ends;
- wherein the ball rest section is circular and comprises a plurality of raised castellations adapted to support the golf ball when the barb is inserted into the ground in a substantially vertical position; and
- wherein the castellations are circumferentially distributed around an upper surface of the ball rest section.

Each of the plurality of castellations may be polygonal in cross-sectional profile. Each of the plurality of polygonal castellations may be hexagonal in cross-sectional profile.

The barb may be generally circular in cross-sectional profile.

The barb may comprise a lip adapted to increase the resistance of the tee to pulling out of the ground.

The ball rest section may comprise opposed extended arms adapted to fixedly engage with the rigid spine section.

The castellations may be formed from a rubberised polymer. The rubberised polymer castellations may be configured to minimise the contact surface area between a ball and the castellations.

The rigid spine section may be formed from a rigid plastics material. The rigid spine section may comprise opposed wings adapted to restrict the insertion depth of the tee when inserted into the ground such that, when so inserted, the ball rest section is located at a predetermined height from the ground such that a golf ball resting on the golf tee is located at a preferred height from the ground for striking the ball with a golf club.

The ball rest section may comprise rigid extended arm portions adapted to fixedly engage with the opposed wings of the spine section.

BRIEF DESCRIPTION OF THE DRAWINGS

Notwithstanding any other forms which may fall within the scope of the present invention, a preferred embodiment/preferred embodiments of the invention will now be described, by way of example only, with reference to the accompanying drawings in which.

In the drawings, like structures are referred to by like numerals throughout the several views. The drawings shown are not necessarily to scale, with emphasis instead generally being placed upon illustrating the principles of the present invention.

Definitions

Figure 1:
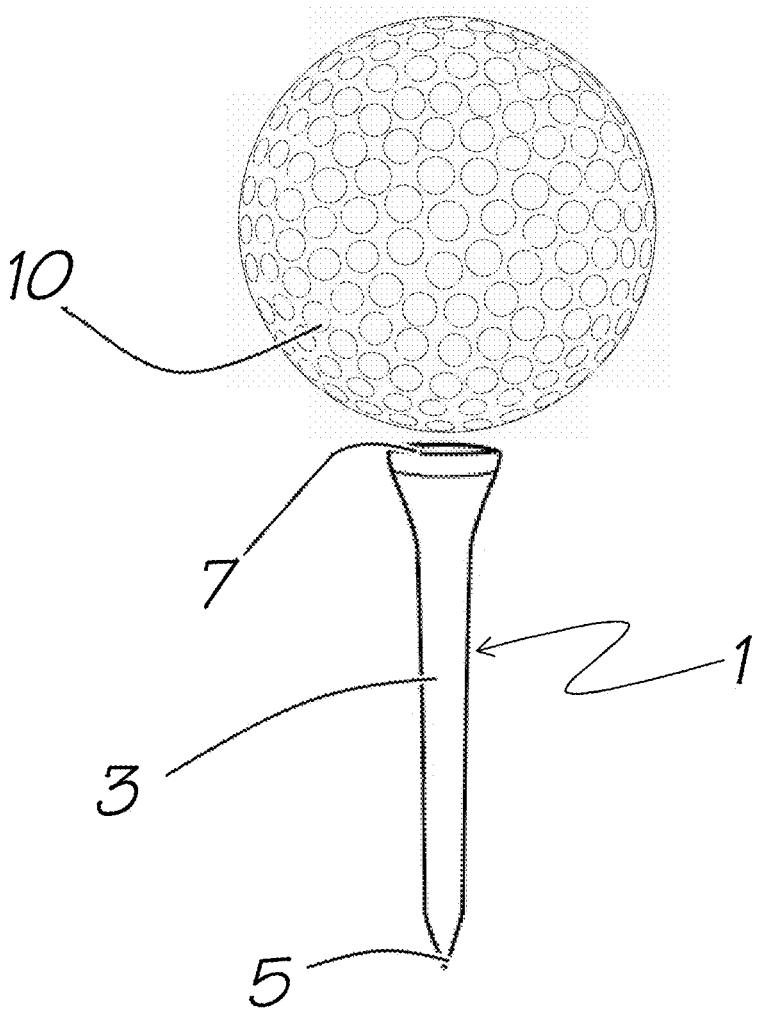
PRIOR ART Figure 1
FIG. 1 shows a prior art golf tee and golf ball.

The following definitions are provided as general definitions and should in no way limit the scope of the present invention to those terms alone, but are put forth for a better understanding of the following description.

Unless defined otherwise, all technical and scientific terms used herein have the same meaning as commonly understood by those of ordinary skill in the art to which the invention belongs. It will be further understood that terms used herein should be interpreted as having a meaning that is consistent with their meaning in the context of this specification and the relevant art and will not be interpreted in an idealized or overly formal sense unless expressly so defined herein. For the purposes of the present invention, additional terms are defined below. Furthermore, all definitions, as defined and used herein, should be understood to control over dictionary definitions, definitions in documents incorporated by reference, and/or ordinary meanings of the defined terms unless there is doubt as to the meaning of a particular term, in which case the common dictionary definition and/or common usage of the term will prevail.

For the purposes of the present invention, the following terms are defined below.

"Golf ball" as used herein, is a specific type of sports ball designed to be used in the game of golf. Golf balls are small dense balls, typically having a hard outer coating surrounding a core, which may consist of multiple layers that affect the overall softness, spin, velocity, and other aspects of the ball's performance. The Rules of Golf specify standards for the minimum size, maximum weight, spherical symmetry, initial velocity and overall distance for golf balls sued in tournament play. Under the Rules, a golf ball has a mass no more than 1.620 ounces (49.5 g), a diameter not less than 1.680 inches (42.7 mm), and performs within specified velocity, distance, and symmetry limits.

"Golf Tee" and "Tee" are used interchangeable herein to refer a device used to raise a golf ball off the ground. Tees are typically made of wood, plastic or another similar material. The Rules specify that a tee must not:

- be longer than 4 inches;
- be designed or manufactured in such a way that it could indicate line of play;
- unduly influence the movement of the ball; or
- otherwise assist the player in making a stroke or in his play.

The articles "a" and "an" are used herein to refer to one or to more than one (i.e., to at least one) of the grammatical object of the article. By way of example, "an element" refers to one element or more than one element.

The term "about" is used herein to refer to quantities that vary by as much as 30%, preferably by as much as 20%, and more preferably by as much as 10% to a reference quantity. The use of the word 'about' to qualify a number is merely an express indication that the number is not to be construed as a precise value.

In the claims which follow and in the preceding description of the invention, except where the context requires otherwise due to express language or necessary implication, the word "comprise" or variations such as "comprises" or "comprising" are used in an inclusive sense, i.e., to specify the presence of the stated features but not to preclude the presence or addition of further features in various embodiments of the invention.

Any one of the terms "including" or "which includes" or "that includes" as used herein is also an open term that also means "including at least" the elements/features that follow the term, but not excluding others. Thus, including is synonymous with and means comprising.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

The phrase "and/or", as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of", or, when used in the claims, "consisting of" will refer to the inclusion of exactly one element of a number or list of elements. In general, the term "or" as used herein shall only be interpreted as indicating exclusive alternatives (i.e., "one or the other but not both") when preceded by terms of exclusivity, such as "either", "one of", "only one of", or "exactly one of". "Consisting essentially of", when used in the claims, shall have its ordinary meaning as used in the field of patent law.

For the purpose of this specification, where method steps are described in sequence, the sequence does not necessarily mean that the steps are to be carried out in chronological order in that sequence, unless there is no other logical manner of interpreting the sequence.

In addition, where features or aspects of the invention are described in terms of Markush groups, those skilled in the art will recognise that the invention is also thereby described in terms of any individual member or subgroup of members of the Markush group.

DETAILED DESCRIPTION

The present invention provides golf tees that exert minimal effect on a golf ball when hit by a golf club. Specifically, the golf tees of the invention are designed to reduce or eliminate contact between the tee and the golf ball that is unnecessary for supporting the golf ball on the tee. Furthermore, the tee is designed to eliminate interference with the forward motion of the ball away from the tee. The tees of the present invention have a minimum area of contact with the ball, and the contacts are strategically placed such that the forward motion of the ball is minimally impacted by the tee. Specifically, the tees of the present invention reduce or eliminate resistance and friction on the ball as it is struck by a golf club due to raised nodules or castellations provided in the ball rest section of the improved tees as described herein. These castellations minimise the contact surface area between the tee and the ball thus minimising the incidence of unwanted spin as the ball is struck from the tee by a golf club, which in turn allows the golf ball to travel longer distances with the same amount of force applied in a golf shot. In certain embodiments, the tee of the present invention results in at least about 1% greater distance, at least about 2% greater distance, or at least about 5% greater distance travelled by a golf ball on tee-off than the same ball teed-off from a conventional tee (control) by the same golfer using the same club. In certain aspects, the ball typically travels about 1-2% further than the same ball teed-off by the same golfer using the same club and a conventional tee.

Golf balls include dimples to lessen wind resistance (also known as "aerodynamic drag" or "drag"). Golf balls go farther through the air when drag is minimised. The air surrounding a smooth ball in motion becomes "detached" from the ball and instead follows the flow of fast-moving air farther away from the ball, creating what is effectively a wake behind the ball. As a result, a wake or area of low pressure is created behind the ball, acting as a vacuum to pull it backwards. Used, scuffed golf balls travelled farther than brand-new ones, as early golfers using smooth balls discovered. By making a pattern of scuffs, scratches, or indentions on the ball, this effect might be replicated. Golf ball manufacturers later learned that a pattern of concave indentations (i.e., "dimples") provided the same effect and that varying the size, shape, number and distribution of dimples.

A ball can change how the air flows over it by adding dimples. Around each dimple, there are a few tiny pockets of turbulent flow. The surrounding, high-speed air flow is mixed with the nearby airflow by the turbulence, which prevents the ball from becoming detached from the air flow. A wake does not develop behind the ball because the wind is tighter around it. Contrarily, dimples do somewhat enhance drag. However, they also result in an increase in "Magnus lift", which is the force that lifts rotating bodies as they move through a medium like air. A driven golf ball exhibits "backspin" (i.e., the ball rotates backwards as though rolling back towards the golfer), which causes a phenomenon known as "Magnus lift".

Backspin imparts an upward force that lifts the ball. But when a golf tee makes contact with a golf ball's dimples, the backspin on the ball might be decreased, which lowers the possible Magnus lift. It is more challenging to strike the golf ball with enough force to get the maximum lift, speed, and distance when the dimples are engaged. The effect of the tee on the golf ball's spin is eliminated by keeping the golf tee of the invention from contacting the dimples on a golf ball, specifically by avoiding contact with the depressed centres of the dimples.

Modifications and variations such as would be apparent to the skilled addressee are considered to fall within the scope of the present invention. The present invention is not to be limited in scope by any of the specific embodiments described herein. These embodiments are intended for the purpose of exemplification only. Functionally equivalent products, formulations and methods are clearly within the scope of the invention as described herein. It will be understood by those skilled in the art that various changes in form and details may be made therein without departing from the spirit and scope of the invention as defined by the appended claims.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Such variations are not to be regarded as a departure from the disclosure, and all such modifications are intended to be included within the scope of the disclosure.

The terminology used herein is for the purpose of describing particular example embodiments only and is not intended to be limiting. The use of the singular includes the plural unless specifically stated otherwise. As used herein, the singular forms "a", "an" and "the" may be intended to include the plural forms as well, unless the context clearly indicates otherwise. The terms "comprise", "comprises", "comprising", "including", and "having", or variations thereof are inclusive and therefore specify the presence of stated features, integers, steps, operations, elements, and/or components, but do not preclude the presence or addition of one or more other features, integers, steps, operations, elements, components, and/or groups thereof.

Figure 2A:
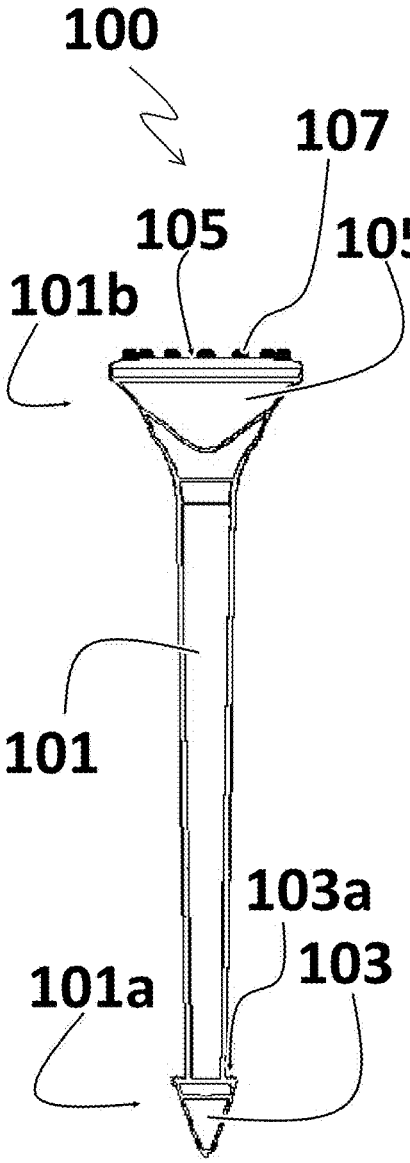
FIGS. 2A to 2G shows a first embodiment of an improved golf tee according to the present invention.
Figure 2B:
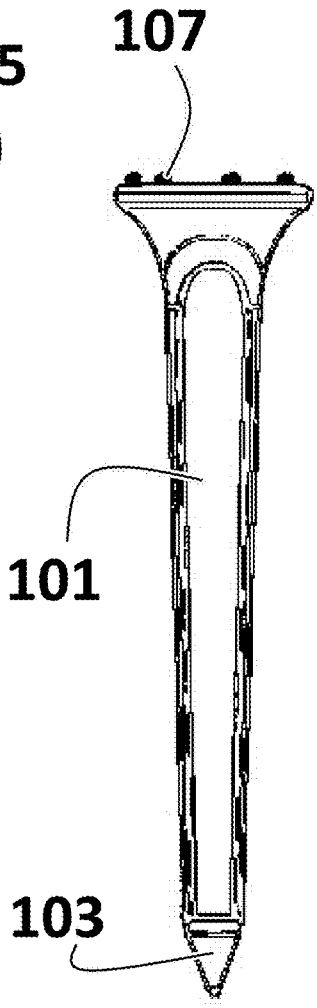
Figure 2C:
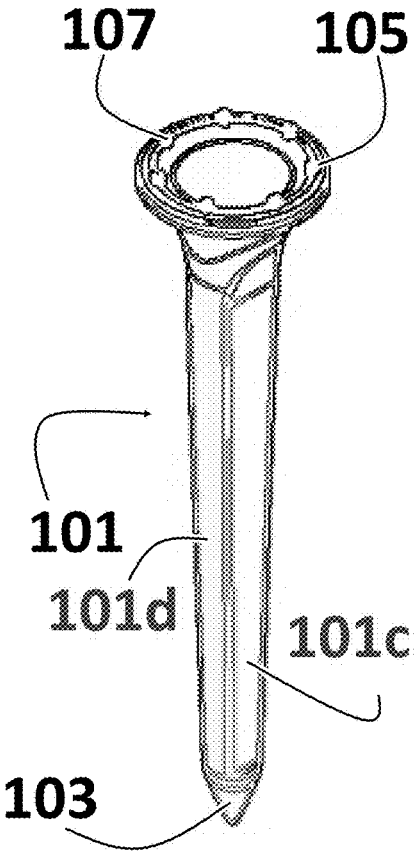

Turning now to the figures, FIGS. 2A to 2C shows a golf tee 100 for supporting a golf ball. Tee 100 comprises a rigid spine section 101 comprising a first spine end 101*a* and a second spine end 101*b*. The rigidity of spine 101 assists to insert the tee 100 into the ground by the user during a game of golf. A barb 103 is located at first spine end 101*a*. Barb 103 is adapted for insertion of the golf tee into the ground in a substantially vertical position. Barb 103 is generally circular in cross-sectional profile and comprises a lip 103*a* adapted to increase the resistance of the tee 100 to pulling out of the ground, particularly when struck by a golf club.

A ball rest section 105 is located at the second spine end 101*b*. Ball rest section 105 is circular and comprises a plurality of raised castellations 107 adapted to support a golf ball when the barb 103 and spine 101 are inserted into the ground in a substantially vertical position. Castellations 107 are generally circumferentially distributed around an upper surface 105*a* of ball rest section 105. Ball rest section 105 is preferable formed from a rubberised polymer material. Similarly, castellations 107 are formed from the rubberised polymer material. The combination of castellations 107 combined with rubberised polymer helps to reduce unwanted back spin from the golf ball on launch after being struck by a golf club, since castellations 107 reduce the contact surface area between the tee 100 and golf ball 10, whilst providing a secure platform to support golf ball 10 in use. Increased side spin on the golf ball causes it to veer off-line and will reduce the distance the ball travels therefore. Also, increased back spin also results in reduced ball carry distance. For the experienced golfer who is able to minimise the side spin of the ball (thus minimising slice or hook of the ball in flight) a reduction in the ball back spin will be the most significant contributing faction in increasing their drive distance. Therefore, minimising the contact surface area between the tee 100 and golf ball 10 which is responsible for imparting spin on the golf ball as it leaves the tee, is advantageous. For a given club and launch speed, a decrease in the rate of back swing of the ball off the tee generally translates to an increased carry distance at all loft angles, thus a golfer using tee 100 which imparts a reduced pack spin rate compared to prior art tees, and without changing any other swing parameters, can generally expect to achieve a longer ball carry distance off the tee as seen in Table 1 which shows the results from comparative testing using the TrackMan Golf system between the tee 100 as disclosed herein (Tour Tee 100) compared with a rubber tee, a driving matt tee, and a wooden tee. Table 1 clearly shows the significantly reduced average spin rate of the ball as it is launched from the tee using Tour Tee 100, while maintaining similar average club speeds.

TABLE 1

Average Ball Metric Test Data (Trackman Golf) - Comparative Tee Testing

| Ball Metric When Struck | Tee: Rubber Tee | Driving Matt Tee | Wooden Tee | Tour Tee (100) |
|---|---|---|---|---|
| Club Speed (kph) | 106.8 | 102.3 | 104.2 | 104.4 |
| Ball Speed (kph) | 157.5 | 155.0 | 153.6 | 156.0 |
| Spin Rate (rpm) | 2840.0 | 2645.0 | 2467.5 | 1560.0 |
| Carry (m) | 239.2 | 240.9 | 236.6 | 239.7 |
| Total Distance (m) | 106.8 | 102.3 | 104.2 | 104.4 |
| Max Ball Height (m) | 35.4 | 38.6 | 29.6 | 26.8 |
| Landing Angle | 42.0 | 43.8 | 37.5 | 32.6 |

From Table 1 it can be seen that, on average, a golf ball when struck from a Tour Tee 100 has about 2% greater ball speed and about 37% lower spin rate than a ball struck from a prior art wooden tee 1 of FIG. 1. In testing, it was also observed that the ball spin rate for a ball struck from tee 100 was up to 56% lower than a ball struck from a wooden tee (minimum test spin rate for the Tour Tee 100 was 1290 rpm with a total drive distance of 273.2 m compared with the minimum spin of 2280 rpm and total distance of 261.8 m observed using a wooden tee). It is also noteworthy from Table 1 that, while the carry distance of a golf ball when struck from tee 100 is comparable to a ball struck from prior art tees, a lower ball height and landing angle translates into an average increase of about 4-5% in the total distance travelled by the golf ball compared to the same golfer using prior art wooden tee 1 of FIG. 1.

Figure 2D:
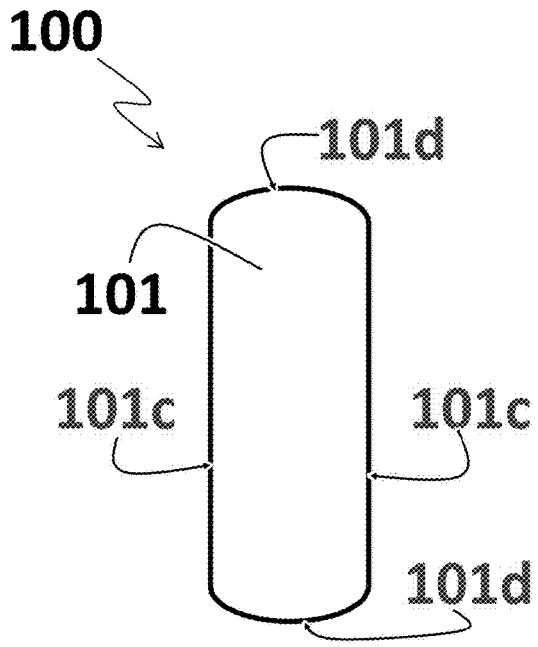
Figure 2E:
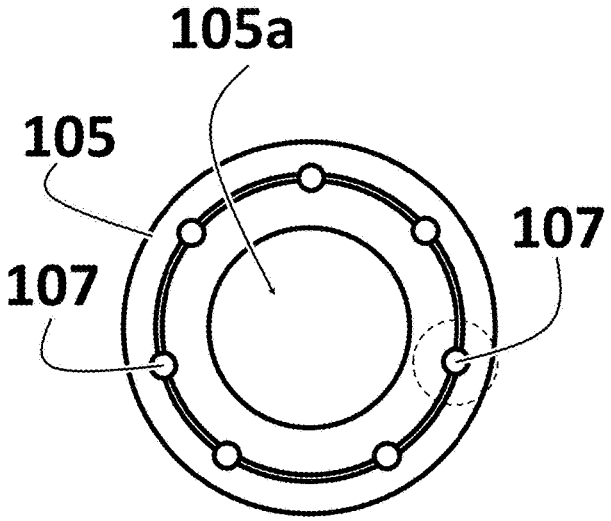
Figure 2F:
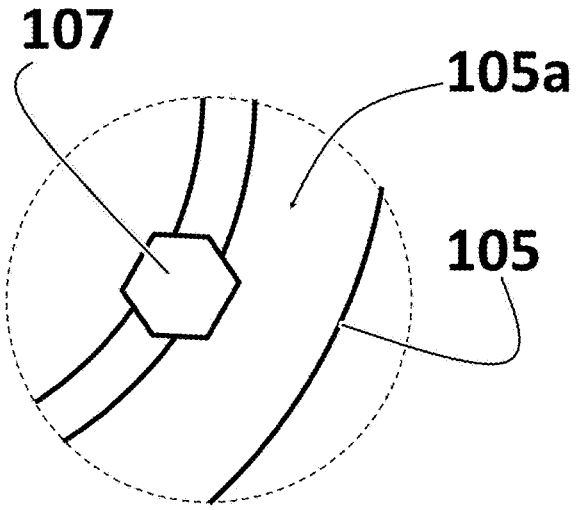
Figure 2G:
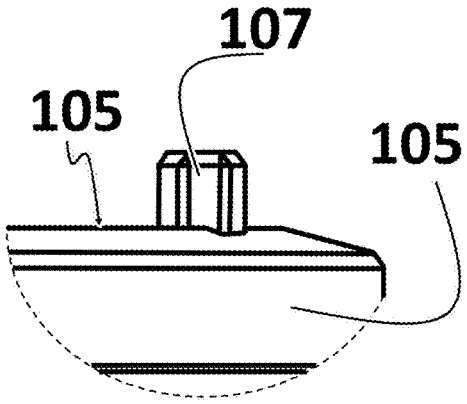

In particular arrangements, spine section 101 is elongate comprising two opposing flat edges 101*c* and two opposing rounded edges 101*d* as seen in cross-sectional detail in FIG. 2D.

Each of the plurality of castellations 107 are either circular or generally polygonal in cross-sectional profile. In particular arrangements, each of the plurality of polygonal castellations 107 are hexagonal in cross-sectional profile as seen in detail top and side views respectively in FIGS. 1F and 1G.

Figures 3A, 3B, 3C:
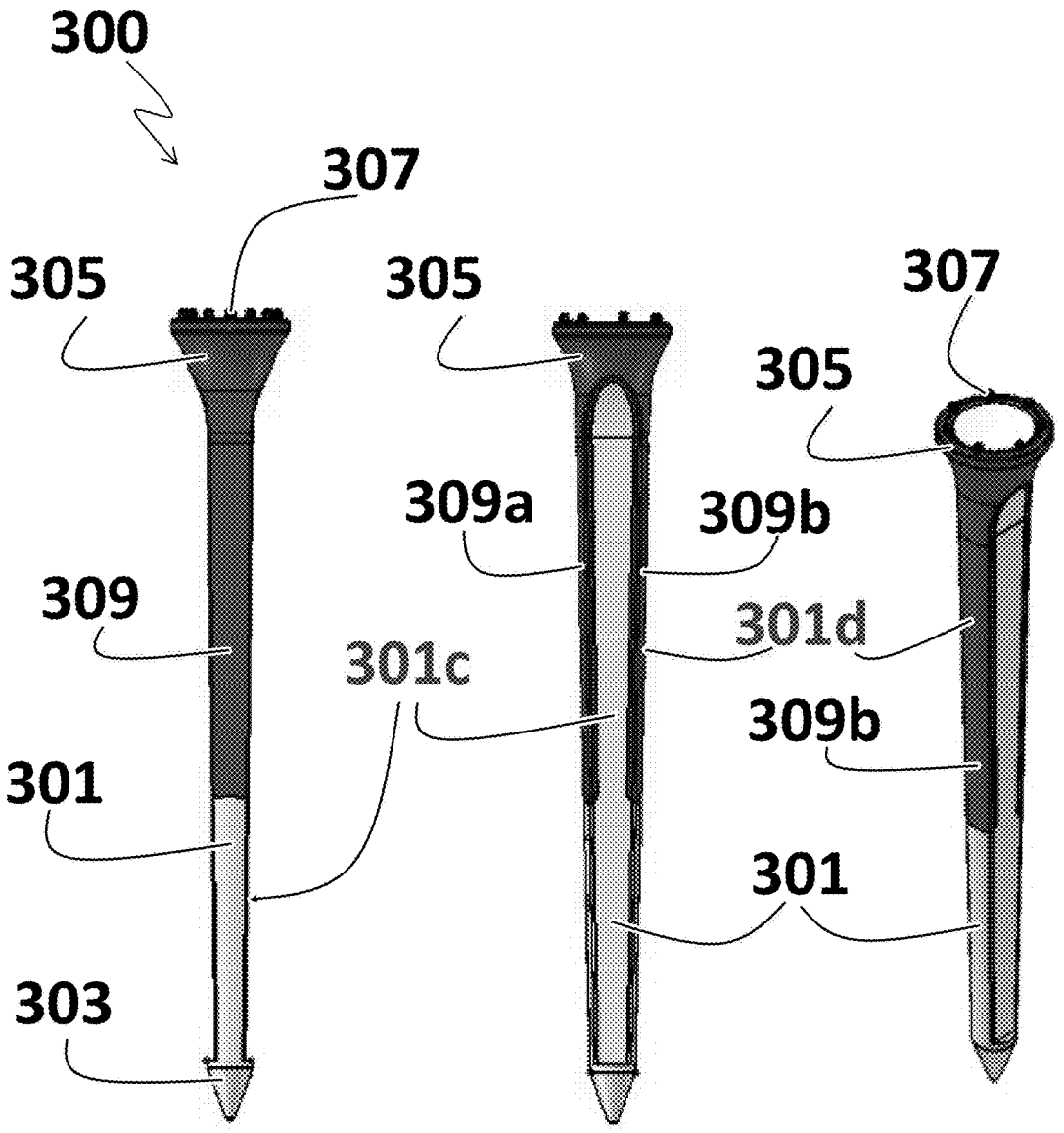
FIGS. 3A to 3C shows a second embodiment of an improved golf tee according to the present invention.

FIGS. 3A to 3C show a further embodiment golf tee 300. As above, tee 300 comprises rigid spine 301, barb 303, and ball rest section 305 comprising a plurality of castellations 307. In embodiment 300, ball rest section 305 comprises opposed extended arms 309 adapted to fixedly engage with the rigid spine section 301. As above, spine section 301 is elongate comprising two opposing flat edges 301*c* and two opposing rounded edges 301*d* formed by arms 309.

Figures 4A, 4B, 4C:
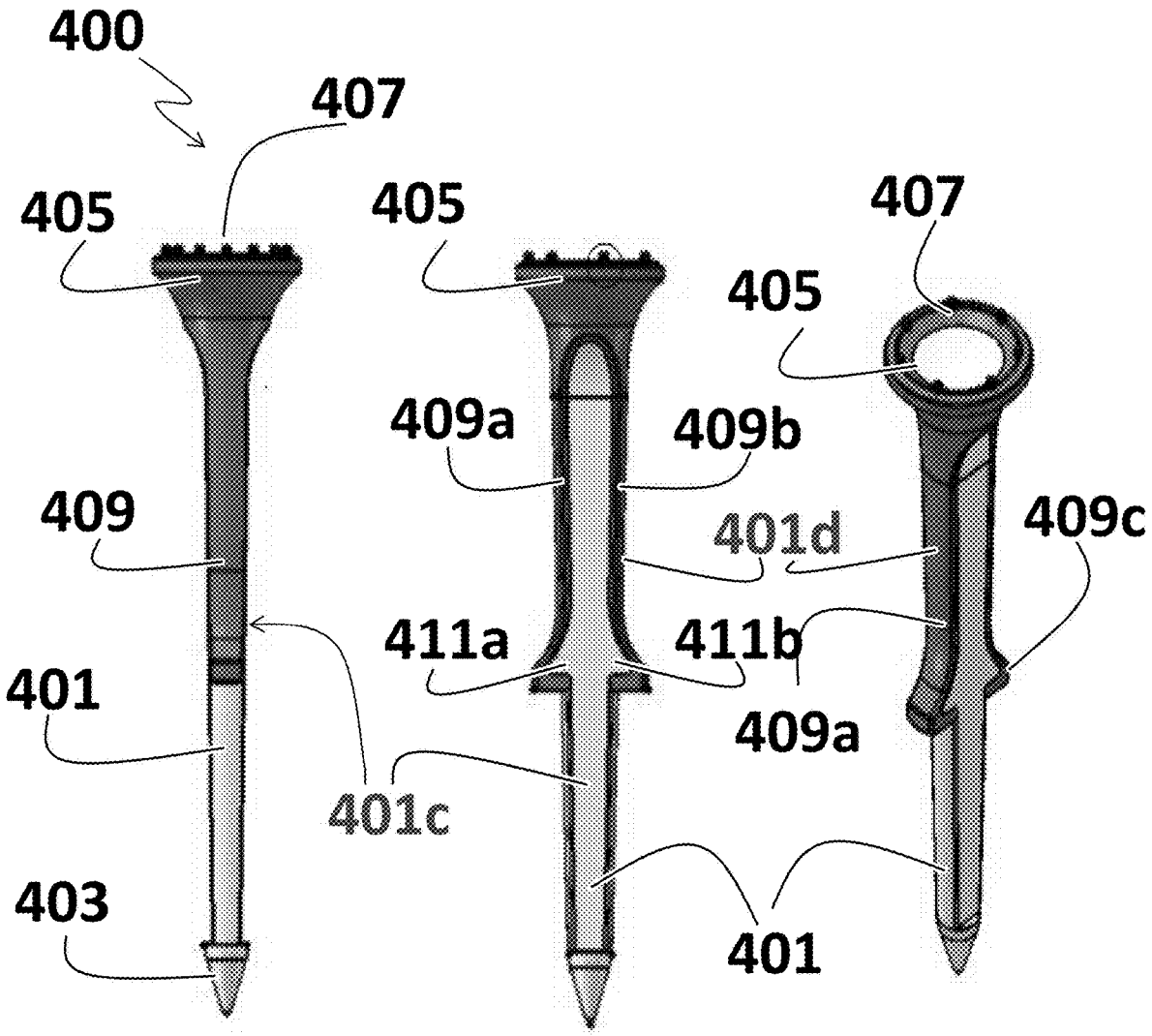
FIGS. 4A to 4C shows a third embodiment of an improved golf tee according to the present invention.

FIGS. 4A and 4B show a further embodiment golf tee 400. As above, tee 400 comprises rigid spine 401, barb 403, and ball rest section 405 comprising a plurality of castellations 407. In embodiment 400, spine section 401 comprises opposed wings 411*a* and 411*b* adapted to restrict the insertion depth of tee 400 when inserted into the ground such that, when so inserted, the ball rest section 405 is located at a predetermined height from the ground such that a golf ball resting on the golf tee 400 is located at a preferred height from the ground for striking the ball with a golf club.

Ball rest section 405 again comprises opposed extended arms 409*a* and 409*b* adapted to fixedly engage with respective wings 411*a* and 411*b* of rigid winged spine section 401. As above, spine section 401 is elongate comprising two opposing flat edges 401*c* and two opposing rounded edges 401*d* formed by arms 409.

Figure 5A:
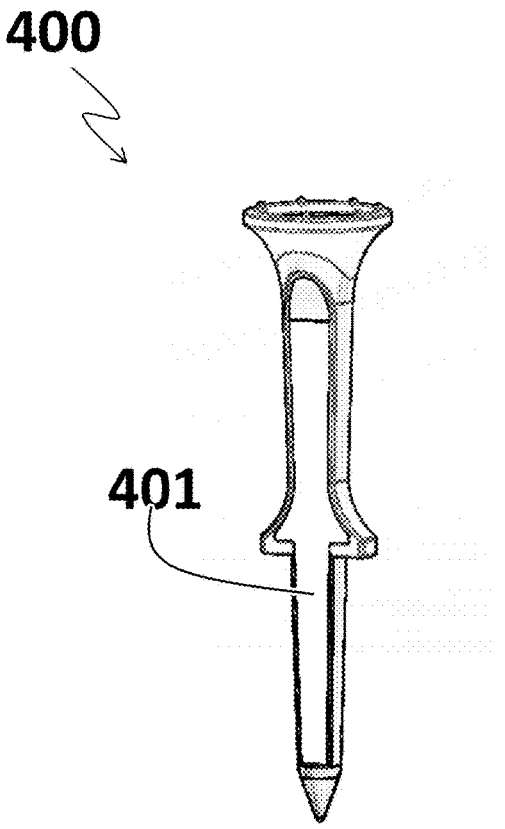
FIGS. 5A to 5C show detail views of the winged tee of FIGS. 4A to 4C according to the present invention.
Figure 5B:
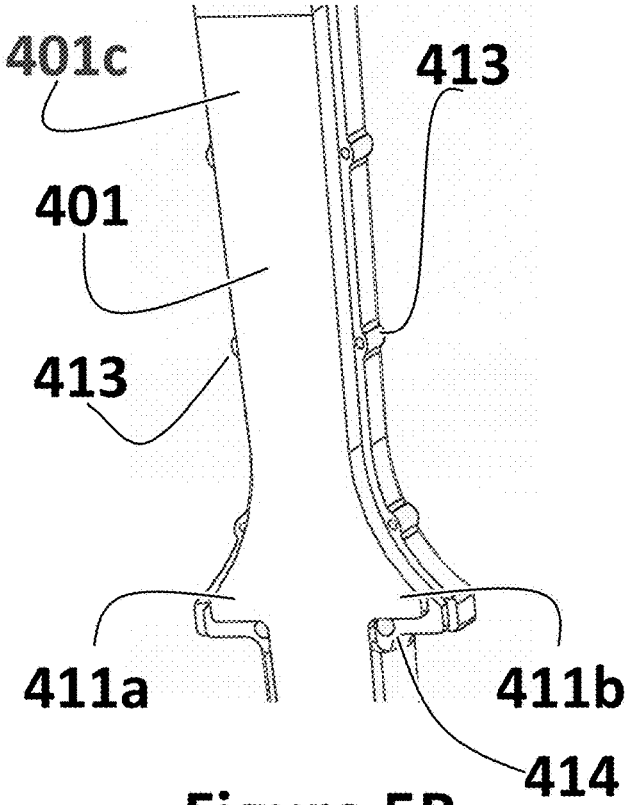
Figure 5C:
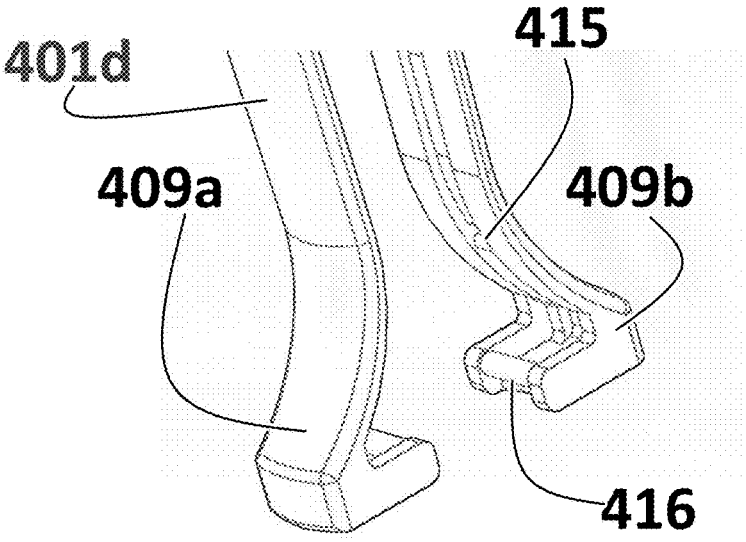

FIGS. 5A to 5C show detail views of a winged tee 400, respectively showing the winged spine 401 in FIG. 4B showing wing projections 411*a* and 411*b* of rigid spine 401 and complementary winged extension arms 409*a* and 409*b* of ball rest section 405. Winged spine 401 includes a plurality of projections 413 and winged extension arms 409*a* and 409*b* includes complementary formations 415 which act to secure winged extension arms 409*a* and 409*b* to winged spine 401. Similarly, wing projections 411*a* and 411*b* of rigid spine 401 include formations 414 adapted to engage with complementary formations 416 of extension arms 409*a* and 409*b* to secure ball rest section 405 to winged rigid spine 401.

In each of the embodiments 100, 300 and 400 described above, the rigid spine section is formed from a rigid plastics material. During manufacturing of the tee of each of the above-described embodiments, ball rest section 105, 305, and 405 respectively, including extended arms 109*a*, 309*a*, and 409*a* respectively, is formed by coextruding/over-moulding the corresponding spine section 101, 301, and 401 with a rubberised polymer material including the plurality of castellations 107, 307, and 407 respectively.

In further arrangements, ball rest section 205 and 305 of tees 200 and 300 respectively, may be manufactured separately to respective spine 201 and 301. For example, ball rest section 205 and 305 may initially be manufactured from a rigid plastics material including rigid extension arms 209*a* and 309*a* respectively and a core portion (not shown) at one end, wherein ball rest portion including castellations 207, 307 may be coextruded/over-moulded the ball rest rigid core section. In such arrangements, rigid extension arms 209*a* and 309*a* respectively may more securely engage respective rigid spine section 201 and 301 to provide greater rigidity to tee 200, 300 thus to reduce the incidence of tee breakage during use.

In the description provided herein, numerous specific details are set forth. However, it is understood that embodiments of the invention may be practiced without these specific details. In other instances, well-known methods, structures and techniques have not been shown in detail in order not to obscure an understanding of this description.

SCOPE OF INVENTION

Thus, while there has been described what are believed to be the preferred arrangements of the invention, those skilled in the art will recognize that other and further modifications may be made thereto without departing from the spirit of the invention, and it is intended to claim all such changes and modifications as fall within the scope of the invention. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It will be appreciated that the methods/apparatus/devices/systems described/illustrated above at least substantially provide a golf tee for improving the interaction between said golf tee and a golf club/ball.

The golf tee described herein, and/or shown in the drawings, are presented by way of example only and are not limiting as to the scope of the invention. Unless otherwise specifically stated, individual aspects and components of the golf tee may be modified, or may have been substituted therefore known equivalents, or as yet unknown substitutes such as may be developed in the future, or such as may be found to be acceptable substitutes in the future. The golf tee may also be modified for a variety of applications while remaining within the scope and spirit of the claimed invention, since the range of potential applications is great, and since it is intended that the present golf tee be adaptable to many such variations.

What is claimed is:

1. A golf tee for supporting a golf ball comprising:

a rigid spine section comprising a first spine end and a second spine end;

a barb located at the first spine end adapted for insertion of the golf tee into a ground in a substantially vertical position; and a ball rest section located at the second spine end, wherein the ball rest section comprises opposed extended arms adapted to fixedly engage with the rigid spine section;

wherein the rigid spine section is elongate comprising two opposing flat edges each extending the length of the spine between the first and second spine ends and two opposing rounded edges each extending the length of the spine between the first and second spine ends;

wherein the ball rest section is circular and comprises a plurality of raised castellations adapted to support the golf ball when the barb is inserted into the ground in the substantially vertical position; and wherein the plurality of raised castellations are circumferentially distributed around an upper surface of the ball rest section.

2. The golf tee of claim 1, wherein each of the plurality of raised castellations are polygonal in cross-sectional profile.

3. The golf tee of claim 2, wherein each of the plurality of polygonal raised castellations are hexagonal in cross-sectional profile.

4. The golf tee of claim 1, wherein the barb is generally circular in cross-sectional profile.

5. The golf tee of claim 1, wherein the barb comprises a lip adapted to increase a resistance of the golf tee to pulling out of the ground.

6. The golf tee of claim 1, wherein the plurality of raised castellations are formed from a rubberised polymer.

7. The golf tee of claim 6, wherein the plurality of rubberised polymer raised castellations are configured to minimise a contact surface area between the golf ball and the raised castellations.

8. The golf tee of claim 1, wherein the rigid spine section is formed from a rigid plastics material.

9. A golf tee for supporting a golf ball comprising:

a rigid spine section comprising a first spine end and a second spine end;

a barb located at the first spine end adapted for insertion of the golf tee into the ground in a substantially vertical position; and a ball rest section located at the second spine end;

wherein the spine section is elongate comprising two opposing flat edges each extending the length of the spine between the first and second spine ends and two opposing rounded edges each extending the length of the spine between the first and second spine ends;

wherein the ball rest section is circular and comprises a plurality of raised castellations adapted to support the golf ball when the barb is inserted into the ground in a substantially vertical position; and wherein the castellations are circumferentially distributed around an upper surface of the ball rest section;

wherein the rigid spine section comprises opposed wings adapted to restrict the insertion depth of the tee when inserted into the ground such that, when so inserted, the ball rest section is located at a predetermined height from the ground such that a golf ball resting on the golf tee is located at a preferred height from the ground for striking the ball with a golf club; and wherein the ball rest section comprises rigid extended arm portions adapted to fixedly engage with the opposed wings of the spine section.

10. The golf tee of claim 9, wherein each of the plurality of raised castellations are polygonal in cross-sectional profile.

11. The golf tee of claim 10, wherein each of the plurality of polygonal raised castellations are hexagonal in cross-sectional profile.

12. The golf tee of claim 9, wherein the barb is generally circular in cross-sectional profile.

13. The golf tee of claim 9, wherein the barb comprises a lip adapted to increase a resistance of the golf tee to pulling out of the ground.

14. The golf tee of claim 9, wherein the plurality of raised castellations are formed from a rubberised polymer.

15. The golf tee of claim 14, wherein the plurality of rubberised polymer raised castellations are configured to minimise a contact surface area between the golf ball and the raised castellations.

16. The golf tee of claim 9, wherein the rigid spine section is formed from a rigid plastics material.

* * * * *